US006575850B1

(12) United States Patent
Iwami et al.

(10) Patent No.: US 6,575,850 B1
(45) Date of Patent: Jun. 10, 2003

(54) GOLF BALL

(75) Inventors: Satoshi Iwami, Kobe (JP); Hidenori Hiraoka, Kobe (JP); Akira Kato, Kobe (JP); Masatoshi Yokota, Kobe (JP)

(73) Assignee: Sumitomo Rubber Industries, Ltd., Hyogo (JP)

( * ) Notice: Subject to any disclaimer, the term of this patent is extended or adjusted under 35 U.S.C. 154(b) by 0 days.

(21) Appl. No.: 09/652,043

(22) Filed: Aug. 31, 2000

(30) Foreign Application Priority Data

Aug. 31, 1999 (JP) ..... 11-244853
Apr. 27, 2000 (JP) ..... 2000-127328

(51) Int. Cl.[7] ..... A63B 37/12; A63B 37/14; A63B 37/06; A63B 37/00

(52) U.S. Cl. ..... 473/378; 473/365; 473/351

(58) Field of Search ..... 473/351, 354, 473/355, 356, 357, 358, 359, 360, 361, 362, 363, 364, 365, 366, 367, 368, 369, 370, 371, 372, 373, 374, 375, 376, 377, 378, 385

(56) References Cited

U.S. PATENT DOCUMENTS 4,884,814 A 12/1989 Sullivan
4,986,545 A * 1/1991 Sullivan ..... 473/372
5,504,156 A * 4/1996 Takezaki et al. ..... 525/93
5,716,293 A * 2/1998 Yabuki et al. ..... 473/363
5,833,552 A * 11/1998 Hamada et al. ..... 473/359
5,849,392 A * 12/1998 Hamada et al. ..... 428/159
6,150,462 A * 11/2000 Rajagopalan et al. ..... 525/74

FOREIGN PATENT DOCUMENTS

GB 2311530 10/1997
JP 09220295 A * 8/1997 ..... A63B/37/00
JP 09220296 A * 8/1997 ..... A63B/37/00
JP 09220297 A * 8/1997 ..... A63B/37/00
JP 09220298 A * 8/1997 ..... A63B/37/00
JP 10179801 7/1998
JP 10179802 7/1998

OTHER PUBLICATIONS

Callister, Jr. , William D., Materials Science and Engineering: An Introduction, 4th Edition. New York: John Wiley & Sons, 1997, p. 498.*
Merriam–Webster's Collegiate Dictionary, www.m–w.com.*

* cited by examiner

*Primary Examiner*—Paul T. Sewell
*Assistant Examiner*—Alvin A. Hunter, Jr.
(74) *Attorney, Agent, or Firm*—Birch, Stewart, Kolasch & Birch, LLP

(57) ABSTRACT

A golf ball which produces high spin rate and accordingly readily stops even when being shot from a rough or in the rain is provided. Such a golf ball is constituted of a core and a cover and the cover has a loss tangent of 0.15 to 0.70 at −10° C. in a temperature distribution curve for dynamic viscoelasticity measured in a tensile mode under conditions of temperature increasing rate of 4° C./min, frequency of 10 Hz and initial strain of 1.0 mm.

9 Claims, No Drawings

GOLF BALL

BACKGROUND OF THE INVENTION

1. Field of the Invention

The present invention relates to a golf ball which produces high spin and thus stops easily like a balata covered ball even when shot from a rough or in the rain, in other words, a golf ball which is superior in so-called controllability.

2. Description of the Background Art

Balata covered golf balls have widely been used generally by skilled and professional golfers because of excellent shot feeling and controllability. However, such balata covered golf balls are produced through complicated manufacturing steps and exhibit poor resistance to cutting. Then, various flexible covers are proposed these days as a substitute for the balata cover.

For example, U.S. Pat. No. 4,884,814 discloses a technique of using flexible ionomer resin as a base resin material for a cover.

Japanese Patent Laying-Open No. 10-179802 proposes a golf ball having a base resin material for a cover structured to have as a main component a heated mixture of two components, that is, ionomer resin and a styrene-butadiene-styrene block copolymer having a polybutadiene block containing epoxy group or a styrene-isoprene-styrene block copolymer having a polyisoprene block containing epoxy group. A cover composition constituting the cover has a flexural modulus of 50 to 300 MPa and a shore D hardness of 40 to 60.

Further, Japanese Patent Laying-Open No. 10-179801 proposes a golf ball having a base resin material for a cover that has as a main component a heated mixture of three components, that is, ionomer resin, acid-modified thermoplastic elastomer or thermoplastic elastomer having an OH group at the end of the polymer chain, and a styrene-butadiene-styrene block copolymer having a polybutadiene block containing epoxy group or a styrene-isoprene-styrene block copolymer having a polyisoprene block containing epoxy group. A cover composition constituting the cover has a flexural modulus of 50 to 300 MPa and a shore D hardness of 40 to 60.

These techniques achieve improvement in shot feeling, controllability and resistance to cutting, however, they are unsatisfactory in spin retention which is represented by a ratio of spin rate under a wet condition to spin rate under a dry condition.

SUMMARY OF THE INVENTION

One object of the present invention is to provide a golfball exhibiting a high ratio of spin rate under a wet condition to spin rate under a dry condition, that is, a high spin retention.

A golf ball according to the present invention is formed of a core and a cover. The cover has a loss tangent (tan δ) of 0.15 to 0.70 at −10° C. in a temperature distribution curve for dynamic viscoelasticity measured in a tensile mode under conditions that temperature increasing rate is 4° C./min, frequency is 10 Hz and initial strain is 1.0 mm.

Preferably, a base resin material of the cover is ionomer resin only, or structured by mixing ionomer resin and one or at least two of elastomer materials containing a rubber element, and mixing therewith 5 to 50 parts by weight of tackifier such as terpene resin and rosin ester resin.

The foregoing and other objects, features, aspects and advantages of the present invention will become more apparent from the following detailed description of the present invention.

DESCRIPTION OF THE PREFERRED EMBODIMENTS

Inventors of the present invention have found that the spin retention is enhanced in proportion to increase of a value of loss tangent (tan δ) of a cover material measured at −10° C. The loss tangent generally refers to a characteristic concerning energy loss of a material. The smaller a value of the loss tangent, the smaller the energy loss and the higher the impact resilience. The loss tangent value is made small according to conventional techniques for the purpose of increasing the impact resilience. On the contrary, according to the present invention, the loss tangent value is set to fall in a range of relatively great values, that is, from at least 0.15 to less than 0.7, preferably from at least 0.25 to less than 0.5. Although the impact resilience slightly deteriorates due to the loss tangent set at 0.15 or more, the impact resilience of an entire golf ball is not significantly influenced by its cover. Therefore, according to the present invention, the influence of a core to the impact resilience is enhanced and accordingly degradation of the impact resilience of the entire golf ball is avoided.

If the loss tangent value is less than 0.15, the spin retention is insufficient. On the other hand, if the loss tangent value exceeds 0.7, the impact resilience and shot feeling are impaired.

Elastic modulus (E*) of the cover of the present invention can be set at a value preferably ranging from 300 to 5000 kg/cm$^2$, more preferably 500 to 3000 kg/cm$^2$, and most preferably 500 to 1500 kg/cm$^2$ in order to keep excellent controllability and shot feeling. For example, an elastic modulus exceeding 5000 kg/cm$^2$, for example, produces hard shot feeling and controllability deteriorates (spin is not easily produced). If the elastic modulus is less than 300 kg/cm$^2$, spin is readily produced and controllability is excellent while shot feeling is soft, a flight carry decreases, and the surface is prone to marring and durability deteriorates.

According to the present invention, the ionomer resin used as a base resin material for the cover is a binary copolymer, for example, of α-olefin and α,β-unsaturated carboxylic acid with 3 to 8 carbons, and at least a part of a carboxyl group thereof is neutralized by metallic ion. Another example of the ionomer resin as a base resin material for the cover is a ternary copolymer of α-olefin, α,β-unsaturated carboxylic acid with 3 to 8 carbons, and α,β-unsaturated carboxylic acid ester with 2 to 22 carbons, and at least a part of a carboxyl group thereof is neutralized by metallic ion. If the base polymer of the ionomer resin is the binary copolymer of α-olefin and α,β-unsaturated carboxylic acid with 3 to 8 carbons, preferably α-olefin is 80 to 90% by weight and α,β-unsaturated carboxylic acid is 10 to 20% by weight. If the base polymer is the ternary copolymer of α-olefin, α,β-unsaturated carboxylic acid with 3 to 8 carbons, and α,β-unsaturated carboxylic acid ester with 2 to 22 carbons, preferably α-olefin is 70 to 85% by weight, α,β-unsaturated carboxylic acid is 5 to 20% by weight, and α,β-unsaturated carboxylic acid ester is 10 to 25% by weight. Preferably, melt index (MI) of these ionomer resin materials is 0.1 to 20 and more preferably 0.5 to 15.

As the α-olefin mentioned above, ethylene, propylene, 1-butene, 1-pentene and the like, for example, are used, and particularly ethylene is preferred. As the α,β-unsaturated carboxylic acid with 3 to 8 carbons, acrylic acid, methacrylic acid, fumaric acid, maleic acid, crotonic acid and the like, for example, are used and particularly acrylic acid and methacrylic acid are preferred. As the unsaturated carboxylic acid ester, methyl (meth)acrylate, ethyl (meth)acrylate, propyl (meth)acrylate, n-butyl (meth)acrylate, isobutyl (meth)acrylate and the like of fumaric acid, maleic acid, for example, are used, and particularly acrylic acid ester and methacrylic acid ester are preferred. As the metallic ion for neutralizing at least a part of the carboxyl group of the copolymer of α-olefin and α,β-unsaturated carboxylic acid, or the ternary copolymer of α-olefin, α,β-unsaturated carboxylic acid and α,β-unsaturated carboxylic acid ester, for example, sodium ion, lithium ion, zinc ion, magnesium ion, potassium ion and the like are used. If the ionomer resin is a copolymer of ethylene and acrylic acid or methacrylic acid with a carboxyl group at least partially neutralized by metallic ion, preferably the ionomer resin has a melt index of 3 to 7 and a flexural modulus of 200 to 400 MPa and accordingly the ionomer resin is of highly rigid and high-flow type.

Specifically, the ionomer resin as described above is commercially available from Mitsui DuPont Polychemical Co., Ltd. as those products under trade names: Hi-milan 1555 (Na), Hi-milan 1557 (Zn), Hi-milan 1605 (Na), Hi-milan 1706 (Zn), Hi-milan 1707 (Na), Hi-milan AM7318 (Na), Hi-milan AM7315 (Zn), Hi-milan AM7317 (Zn), Hi-milan AM7311 (Mg) and Hi-milan MK7320 (K). Examples of the ternary copolymer ionomer resin are Hi-milan 1856 (Na), Hi-milan 1855 (Zn), Hi-milan AM7316 (Zn) and the like. The ionomer resin is also commercially available from DuPont Co. under trade names Surlyn 8945 (Na), Surlyn 8940 (Na), Surlyn 8945 (Na), Surlyn 9910 (Zn), Surlyn 9945 (Zn), Surlyn 7930 (Li) and Surlyn 7940 (Li). Examples of the ternary copolymer ionomer resin are Surlyn AD8265 (Na), Surlyn AD8269 (Na) and the like.

The ionomer resin is commercially available from Exxon Chemical Japan Ltd. as Iotek 7010 (Zn), Iotek 8000 (Na) and the like. It is noted that those symbols Na, Zn K, Li, Mg and the like in the parentheses, which follow the trade names of the ionomer resin, represent a metal type of the neutralizing metallic ion. According to the present invention, the ionomer resin used as a base resin material for the cover may be a mixture of at least two of the materials above, or a mixture of at least two of the above ionomer resin materials neutralized by monovalent metallic ion and ionomer resin materials neutralized by bivalent metallic ion.

The base resin material for the cover according to the present invention may be ionomer resin mixed with at least one of elastomer materials having a rubber element. The elastomer having a rubber element is a block copolymer having polybutadiene block and polyisoprene block obtained from a conjugated diene compound as a comonomer. As the conjugated diene compound, one or at least two of butadiene, isoprene, 1,3-pentadiene, 2,3-dimethyl-1,3-butadiene and the like may be selected, for example, and especially butadiene, isoprene and a combination of them are preferred. As other components constituting the block copolymer, one or at least two of styrene, α-methylstyrene, vinyltoluene, p-3 butylstyrene, 1,1-diphenylethylene and the like may be selected, and styrene is preferred.

Specifically, examples of the block copolymer are styrene-butadiene-styrene block copolymer (SBS structure), styrene-ethylene-butylene-styrene block copolymer (SEBS structure) corresponding to the SBS structure in which the double bond of the butadiene is hydrogenated, styrene-isoprene-styrene block copolymer (SIS structure), styrene-ethylene-propylene-styrene block copolymer (SEPS structure) corresponding to the SIS structure in which the double bond of the isoprene is hydrogenated, modified versions of these copolymers, and the like.

Content of the styrene (or alternative monomer) in the copolymers of the SBS structure, SEBS structure, SIS structure and SEPS structure each is 10 to 50% by weight and particularly 15 to 45% by weight. If the content is less than 10% by weight, the cover is too soft and resistance to cutting is likely to decrease. If the content exceeds 50% by weight, the ionomer resin cannot be made flexible enough and shot feeling and controllability deteriorate.

According to the present invention, the copolymer of the SBS structure, SEBS structure, SIS structure and SEPS structure may partially contain an epoxy group.

A styrene-butadiene-styrene block copolymer (SBS structure) having a polybutadiene block containing an epoxy group is specifically a block copolymer having polystyrenes at both ends and the intermediate layer is the polybutadiene containing the epoxy group. The double bond of the polybutadiene portion may be partially or entirely hydrogenated. A styrene-isoprene-styrene block copolymer (SIS structure) having a polyisoprene block containing an epoxy group is specifically a block copolymer having polystyrenes at both ends and the intermediate layer is the polyisoprene containing the epoxy group. The double bond of the polyisoprene portion may be partially or entirely hydrogenated.

Preferably, content of the epoxy group in the block copolymer of the epoxidized SBS structure or SIS structure is 0.05 to 10% by weight and preferably 0.2 to 5%. by weight. If the epoxy group content is less than 0.05% by weight, the amount of reacted epoxy group and free carboxyl group in the ionomer resin decreases to cause lower dispersibility of the block copolymer having the epoxidized SBS structure or SIS structure into the ionomer resin, resulting in a possibility of damaging durability. If the epoxy group content is greater than 10% by weight, too much epoxy group and free carboxyl group in the ionomer resin react to each other to cause lower flowability, resulting in difficulty in molding a ball.

The block copolymer of the epoxidized SBS structure or SIS structure is commercially available, for example, from Daicel Chemical Industries Ltd., as a styrene-butadiene-styrene block copolymer (SBS structure) having a polybutadiene block containing epoxy groups, under trade name of ESBS AL005 and the like, and as a styrene-butadiene-styrene block copolymer having a partially hydrogenated polybutadiene block containing epoxy groups under trade name of ESBS AT018, ESBS AT019 and the like. These materials are advantageously employed according to the present invention.

The block copolymer of the SEBS structure or SEPS structure having hydroxyl groups at its ends of polymer chains is commercially available, for example, from Kuraray Co., Ltd. under trade name of HG-252.

The diene-based block copolymer modified by the epoxy group is commercially available from Daicel Chemical Industries Ltd. under trade name of Epofriend, for example.

According to the present invention, preferably the mixing ratio of the ionomer resin and elastomer of the block copolymer of the SBS structure or SIS structure is preferably 95:5 to 50:50 by weight, and preferably 90:10 to 55:45. If the ratio of the ionomer resin exceeds the above range, the ionomer resin is not sufficiently made flexible so that the ionomer resin exhibits its inherent characteristics. Then, the shot feeling and controllability could become worse. If the ratio of the ionomer resin is smaller than the above range, the cover could become too soft and thus excessively increase the spin rate. Consequently, the carry could decrease and the resistance to cutting could deteriorate.

According to the present invention, desired characteristics can be obtained by mixing the above ionomer resin and the block copolymer of the SBS or SIS structure while heating the mixture. This mixture with heating is done usually by using an internal mixer such as kneading type twin screw extruder, Banbury, and kneader at a temperature of 150 to 260° C., for example.

Examples of tackifier used according to the present invention are coumarone-indene-based resin, terpene-based resin, rosin derivative, phenol-formaldehyde-based resin, alkylphenol-based resin, petroleum-based resin, xylene-formaldehyde-based resin, oligomer such as polybutene and the like, liquid rubber such as liquid polyisoprene, and the like. In particular, the terpene-based resin and rosin-ester-based resin are preferable.

The terpene resin refers to a polymer of terpene monomer and the polymer having a second component in the polymer chain. The terpene resin includes the one represented by general formula (1) showing the basic structure, styrene-based terpene resin having a basic structure represented by general formula (2), phenol-modified terpene resin having a basic structure represented by general formula (3), and hydrogenated terpene resin. It is noted that m and n in general formulas (1) to (3) represent integers.

Formula (1)

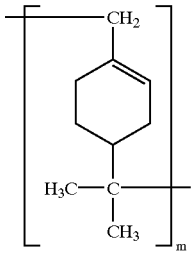

Formula (2)

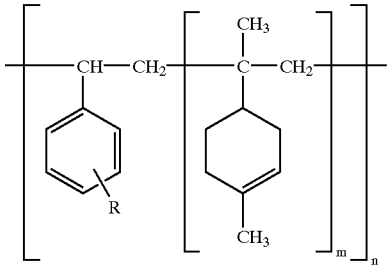

Formula (3)

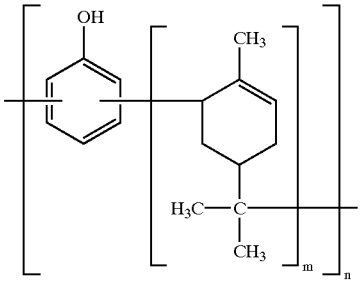

Examples of these tackifiers are, coumarone resin of trade name Process Resin A81, Process Resin AC5 and Process Resin TX available from Kobe Petrochemical Industries, Co, Ltd., trade name Coumarone CL from Ouchi Shinko Chemical Industrial Co., Ltd. and Coumarone Resin NG4 from Nippon Steel Chemical Industries, Co., Ltd. The terpene-phenol resin is available from Sumitomo Chemical Co., Ltd. under trade name of Tackiroll 101, Tackiroll 160, Tackiroll EP20 and Tackiroll EP30 and from Sumitomo Durez Co., Ltd. under trade name of Sumilite Resin PR19900.

Examples of the petroleum-based resin are hydrogenated terpene resin Clearon of Yasuhara Chemical Co., Ltd., Alcon P90 and Estergum H of Arakawa Chemical Industries, Ltd., Petrozin #80 and Hi-rez G100X of Mitsui Petro Chemical Industries, Ltd.

Examples of the rosin derivative are Nikanol A70 of Mitsubishi Gas Chemical Company Inc., Rignol R70 of Libnite, and Rosin Ester Resin of Arakawa Chemical Industries, Ltd.

These tackifiers are dispersedly mixed with a base resin material of the cover to give a suitable tackiness to the cover and accordingly enhance the tackiness of the golf ball to the surface of a club face when the club hits the ball. For this purpose, 5 to 50 parts by weight of the tackifier is mixed with 100 parts by weight of the base resin material of the cover, preferably 10 to 40 parts by weight and particularly preferably 20 to 30 parts by weight of the tackifier is mixed therewith. If the amount of the tackifier is less than 5 parts by weight, the tackiness applied to the cover is insufficient. If the amount of the tackifier exceeds 50 parts by weight, the hardness, feeling and durability which are basic characteristics of a cover are likely to deteriorate.

According to the present invention, preferably the ratio between the ionomer resin, elastomer containing a rubber element, and tackifier that are mixed is preferably 30 to 70/20 to 60/5 to 30 parts by weight per 100 parts by weight of the total three components of the ionomer resin, elastomer containing a rubber element and tackifier. If the ratio of the ionomer resin is too low, loss tangent tan δ increases and hardness and resilience become lower. On the contrary, if the ratio of the ionomer resin is too high, both of the loss tangent (tan δ) and spin retention decrease. If the ratio of the elastomer containing a rubber element is too low, the effect of the tackifier is not sufficiently exhibited, so that the spin retention decreases. If the elastomer ratio is too high, hardness is too low.

A golf ball of the present invention may have a single layer cover or multi-layer cover. If the cover is the multi-layered one, the outermost layer of the cover has a thickness of 1.0 to 3.0 mm, preferably 1.3 to 2.4 mm. Molding would be difficult if the thickness is too small while resilience decreases if the thickness is too great.

To a cover composition for forming a cover according to the present invention, various types of additives may be added as required, for example, pigment, dispersing agent, antioxidant, ultraviolet absorber, light stabilizer and the like.

The present invention is applicable to golf balls having any of a solid core and a thread-wound core.

The solid core may be of a single layer structure or a multi-layer structure having at least two layers. For example, a solid core for a two-piece ball is produced by mixing, per 100 parts by weight of polybutadiene, a total of 10 to 50 parts by weight of a crosslinking agent alone or of at least two types formed of α,β-monoethylenic unsaturated carboxylic acid such as acrylic acid and methacrylic acid or metallic salt thereof, trimethylol propane trimethacrylate polyfunctional monomer and the like, 10 to 30 parts by weight of a filler such as zinc oxide and barium sulfate, 0.5 to 5 parts by weight of peroxide such as dicumyl peroxide, and if necessary, 0.1 to 1 parts by weight of an antioxidant. The resultant mixture is heated and pressed by press crosslinking at 140 to 170° C. for 10 to 40 minutes, for example, to mold the mixture into a globular crosslinked product.

According to the present invention, the diameter of the solid core is preferably in a range of 36.5 to 40.7 mm, and more preferably 38.0 to 40 mm. The amount of deformation of the core, generated when a load is applied to the core starting from an initial load of 10 kg and ending with a final load of 30 kg, is 0.6 to 7.0 mm, and preferably 0.8 to 3.0 mm.

The thread-wound core is constituted of a center and a rubber thread layer formed by winding a rubber thread in an elongated state around the center. The center may be a solid center composed of a vulcanized product of rubber composition, or a liquid center formed by sealing liquid such as water and paste in a center cover made of vulcanized rubber. If the center is a solid center, preferably its diameter is 28 to 38 mm and the amount of deformation when the initial load applied to the center is 10 kg and the final load is 30 kg is 0.5 to 6.0 mm, more preferably 0.5 to 5 mm, and especially preferably 0.5 to 2.5 mm. If the diameter of the solid center is less than 28 mm, the shot angle is small and the spin rate increases, resulting in a shorter flight carry. If the diameter of the solid center is greater than 38 mm, winding of the rubber thread around the center reaches an end before the rubber thread is tensioned. Consequently, there is no sufficient resilience of the rubber thread layer so that resilience properties of the ball deteriorate, and possibly a long flight carry could be difficult to achieve. If the amount of deformation of the solid center is smaller than 0.5 mm, the solid center is too hard so that the ball having such a solid center cannot provide an excellent shot feeling. If the amount of deformation of the solid center is greater than 6.0 mm, the center is too soft, making it difficult to obtain a proper hardness as a ball. In this case, the initial speed of the ball could decrease. If the center is a liquid center, its diameter is preferably 26 to 34 mm. If the diameter of the liquid center is smaller than 26 mm, the shot angle is small and the spin rate increases, so that it would be difficult to obtain a long flight carry. If the diameter of the liquid center exceeds 34 mm, a predetermined hardness of a ball is difficult to obtain and the rubber thread layer becomes thinner. As a result, the resilience properties deteriorate to cause a shorter flight carry.

The above rubber thread is produced by vulcanizing a rubber composition produced by blending natural rubber or blend rubber of natural rubber and synthetic polyisoprene with antioxidant, vulcanization accelerator, sulfur and the like.

EXAMPLE

The present invention is hereinafter described specifically in conjunction with examples.

Examples 1–4

Comparative Examples 1–4

Golf balls were manufactured through the following processes (1) to (3) as Examples and Comparative Examples.

(1) Production of Solid Core

A rubber composition having the components shown in Table 1 was prepared. The rubber composition was fed to a mold to fill it and then molded through vulcanization. A resultant product was a spherical solid core having a diameter of 39.0 mm. The vulcanization was done at 165° C. for 20 minutes as shown with Table 1. The amount of deformation of the solid core when loads of 10 to 30 kg were applied thereto (deformation generated when loads were applied starting from an initial load of 10 kg and ending with a final load of 30 kg) was 0.9 mm. The amounts of the mixed components are indicated by parts by weight.

(2) Preparation of Cover Composition

Materials shown in Table 2 were mixed at the ratio shown therein by a two shaft extruder of kneading type to prepare a pellet-shaped cover composition. The amounts of mixed materials are indicated by parts by weight and those components represented by the trade names are specifically shown in Table 3.

The extrusion was done under conditions of the screw diameter of 45 mm, the number of revolutions of the screw of 200 rpm, and screw L/D of 35, and the mixture was heated to 220 to 260° C. at the location of the die of the extruder.

(3) Production of Golf Ball

Two hemispherical half shells were produced from the cover composition described in the above section (2), the shells were used to enclose the core described in the section (1), and then press-formed in a mold for a ball at 150° C. for 2 minutes. The core was thus covered with the cover, paint was applied to the surface and accordingly golf balls having an outer diameter of 42.8 mm (the thickness of the cover was 1.9 mm) were produced for Examples 1 to 4 and Comparative Examples 1 to 4. Combinations of centers and covers employed for producing these golf balls are shown in Table 2 together with physical properties of the balls described later.

TABLE 1

| | | | |
|---|---|---|---|
| Solid Core Composition | BR11 | ※1 | 100 |
| | Zinc Acrylate | | 28 |
| | Zinc Oxide | | 15 |
| | Barium Sulfate | | 20 |
| | Antioxidant | ※2 | 0.5 |
| Physical Properties of Solid Core | Weight (g) | | 30.0 |
| | Diameter (mm) | | 39.0 |
| | Deformation Amount (mm) (10 kg→30 kg) | | 0.9 |

(Condition of Vulcanization) 165° C. × 20 min

※1: 1,4-cis-polybutadiene manufactured by JSR Corporation (cis content 96%)

※2: Nocrac NS-6 manufactured by Ouchi Shinko Chemical Industrial Co., Ltd. 2,5-di, tertiary-butyl hydroquinone

TABLE 2

| | Example | | | | Comparative Example | | | |
|---|---|---|---|---|---|---|---|---|
| | 1 | 2 | 3 | 4 | 1 | 2 | 3 | 4 |
| Surlyn 8945 | 25 | — | 20 | 25 | 25 | 20 | — | — |
| Surlyn 9945 | 25 | — | 20 | 25 | 25 | 20 | — | — |
| Iotek 7010 | — | 20 | — | — | — | — | 10 | 10 |
| Iotek 8000 | — | 20 | — | — | — | — | 5 | 5 |
| HG252 | 35 | 60 | 40 | 50 | 35 | 40 | 85 | 85 |

TABLE 2-continued

| | Example | | | | Comparative Example | | | |
|---|---|---|---|---|---|---|---|---|
| | 1 | 2 | 3 | 4 | 1 | 2 | 3 | 4 |
| Epofriend A1010 | 15 | — | 20 | — | 15 | 20 | — | — |
| Terpene Resin*1) | 20 | 20 | 10 | 10 | — | — | 20 | — |
| Titanium Dioxide | 2 | 2 | 2 | 2 | 2 | 2 | 2 | 2 |
| Barium Sulfate | 2 | 2 | 2 | 2 | 2 | 2 | 2 | 2 |
| Elastic Modulus (E*) (kg/cm$^2$) | 1000 | 700 | 1000 | 1000 | 2000 | 1000 | 10000 | 7000 |
| Loss Tangent (−10° C.) | 0.25 | 0.40 | 0.20 | 0.35 | 0.07 | 0.08 | 0.10 | 0.09 |
| Dry Spin Rate (rpm) | 6900 | 7200 | 6900 | 7200 | 7300 | 7000 | 7000 | 7100 |
| Wet Spin Rate (rpm) | 3800 | 4400 | 3380 | 4000 | 2700 | 2650 | 2250 | 2200 |
| Spin Retention (%) | 55 | 61 | 49 | 56 | 37 | 38 | 32 | 31 |

*1)hydrogenated terpene resin manufactured by Yasuhara Chemical Co., Ltd. under trade name of Clearon P105, which is hydrogenated version of the compound represented by General Formula 1

TABLE 3

| | Metal Type | Acid Content | Neutralization Degree | Shore D Hardness | M1*2) | Flexural Modulus (Kg/cm$^2$) | Component | Manufacturer |
|---|---|---|---|---|---|---|---|---|
| Surlyn 9945 | Zn | 15 | 50 | 59 | 5.2 | 2,255 | Ethylene/methacrylic acid binary copolymerization ionomer neutralized by Zn | Mitsui-Dupont |
| Surlyn 8945 | Na | 15 | 50 | 61 | 4.8 | 2,775 | Ethylene/methacrylic acid binary copolymerization ionomer neutralized by Na | Polychemical Co., Ltd. |
| Iotek 7010 | Zn | 15 | 35 | 54 | 0.8 | 1,937 | Ethylene/acrylic acid binary copolymerization ionomer neutralized by Zn | Exxon Chemical |
| Iotek 8000 | Na | 15 | 45 | 60 | 0.8 | 3,263 | Ethylene/acrylic acid binary copolymerization ionomer neutralized by Na | Japan Ltd. |
| Epofriend A1010 | | | | 70*1) | — | — | Epoxy-modified styrene/butadiene/styrene copolymer, rubber component:styrene = 60:40 | Daicel Chemical Industries Ltd. |
| HG252 | | | | 80*1) | | | Hydrogenated polystyrene block-isoprene/butadiene random polymer block-polystyrene block copolymer with OH groups at ends | Kuraray Co., Ltd. |

*1)JIS-A Hardness
*2)Condition of Measurement: 190° C., 2.16 kg load

Performances of golf balls of Examples and Comparative Examples were evaluated by the following method.

(1) Measurement of Spin Rate

A sand wedge club was attached to a swing robot manufactured by True-Temper to hit a ball at a head speed of 21 m/s. The ball was accordingly shot and pictures of marks applied to the ball were taken through sequential photography so as to measure the spin rate. The measurement was done under a normal dry condition and a wet condition generated by wetting the club face with water.

Spin retention is defined as a value of, spin rate under wet condition/spin rate under dry condition×100.

(2) Loss Tangent (tan δ)

A strip-shaped sample was made from the cover composition to have a thickness of 2 mm, a width of 4 mm and a length of 30 mm. A remodeled version of viscoelastic spectrometer DVE-200 manufactured by Shimadzu Corporation was used to measure dynamic viscoelasticity with a temperature distribution curve in a tensile mode under conditions of initial strain of 1.0 mm, amplitude of 0.25% (0.05 mm), temperature range of −100° C. to 100° C., and frequency of 10 Hz. It is noted that the length of a deformed site of the sample was 20 mm (the total length of the sample was 30 mm of which 5 mm portions on both ends were secured).

It is seen from Table 2 that the spin retention exceeds approximately 50% in Examples 1 to 4 and accordingly the spin retention in those examples is superior to that in any of Comparative Examples.

According to the present invention, a golf ball has a cover with a loss tangent set at 0.15 to 0.70 at −10° C., so that a ratio of a spin rate under wet condition to a spin rate under dry condition, that is, the spin retention is significantly enhanced.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A golf ball comprising a core and a cover, wherein said cover has a loss tangent (tan δ) of 0.25 to 0.5 at −10° C. in a temperature distribution curve for dynamic viscoelasticity measured in a tensile mode under conditions for temperature increasing rate of 4° C./min, frequency of 10 Hz and initial strain of 1.0 mm.

2. A golf ball comprising a core and a cover, wherein said cover has a loss tangent (tan δ) of 0.20 to 0.70 at −10° C. in a temperature distribution curve for dynamic viscoelasticity measured in a tensile mode under conditions for temperature increasing rate of 4° C./min, frequency of 10 Hz and initial strain of 1.0 mm.

3. The golf ball according to claim 1 or 2, wherein a tackifier is mixed with a base resin material for a composition for said cover.

4. The golf ball according to claim 3, wherein 5 to 50 parts by weight of the tackifier is mixed with 100 parts by weight of the base resin material.

5. The golf ball according to claim 3, wherein the tackifier is terpene resin and/or rosin ester resin.

6. The golf ball according to claim 3, wherein said base resin material of said cover composition is formed of ionomer only.

7. The golf ball according claim 1 or 2, wherein said cover is composed of a base resin material formed of ionomer and an elastomer having a rubber element, and a tackifier mixed with said base resin material.

8. The golf ball according to claim 7, wherein said cover made from base resin contains at least two elastomer materials having a rubber element.

9. The golf ball according to claim 7, wherein the ratio between the ionomer resin elastomer containing a rubber element, and tackifier that are mixed is 30 to 70/20 to 60/5 to 30 parts by weight per 100 parts by weight of the total three components of the ionomer resin, elastomer containing rubber and tackifier.

* * * * *